US006390595B1

(12) United States Patent
Kusumi

(10) Patent No.: US 6,390,595 B1
(45) Date of Patent: May 21, 2002

(54) INK JET RECORDING DEVICE HAVING A RECOVERY FUNCTION FOR RESTORING A PRINTING FUNCTION OF AN INK HEAD DURING A STANDBY MODE THEREOF

(76) Inventor: Tatsuya Kusumi, c/o NEC Niigata, Ltd., 7546, Oaza Yasuda, Kashiwazaki-shi Niigata (JP)

( * ) Notice: Subject to any disclaimer, the term of this patent is extended or adjusted under 35 U.S.C. 154(b) by 0 days.

(21) Appl. No.: 09/132,202

(22) Filed: Aug. 11, 1998

(30) Foreign Application Priority Data

Aug. 11, 1997 (JP) ..... 9-216148

(51) Int. Cl.[7] ..... B41J 2/165
(52) U.S. Cl. ..... 347/33; 347/29
(58) Field of Search ..... 342/32, 33, 30; 347/30, 32–33

(56) References Cited

U.S. PATENT DOCUMENTS

| | | | | | |
|---|---|---|---|---|---|
| 4,745,414 A | * | 5/1988 | Okamura et al. | ..... | 347/33 |
| 5,202,702 A | | 4/1993 | Terasawa et al. | ..... | 347/30 |
| 5,394,178 A | * | 2/1995 | Grange | ..... | 347/33 |
| 5,563,638 A | * | 10/1996 | Osborne | ..... | 347/32 |
| 5,612,721 A | | 3/1997 | Ishize | ..... | 347/33 |
| 5,644,345 A | * | 7/1997 | Toniolo | ..... | 347/33 |
| 5,793,391 A | * | 8/1998 | Kawakami et al. | ..... | 347/33 |
| 5,847,727 A | * | 12/1998 | VanLiew et al. | ..... | 347/33 |

FOREIGN PATENT DOCUMENTS

| | | | | |
|---|---|---|---|---|
| EP | 0604068 | 3/1993 | | |
| JP | 7-323557 | 12/1995 | | |
| JP | 8-187869 | 7/1996 | | |
| JP | 408207293 | * 8/1996 | ..... | 247/33 |
| JP | 8-332733 | 12/1996 | | |

* cited by examiner

*Primary Examiner*—N. Le
*Assistant Examiner*—Shih-wen Hsieh

(57) ABSTRACT

An ink jet printer has a recovery system for restoring the function of the ink nozzles during a standby mode of the ink head. The recovery system includes a wiper for wiping the nozzle surface of the ink head and cap members for capping the nozzles for ink absorption operation, both driven by the movement of the ink head assembly. The ink head assembly first moves in the first direction from the operational area to the standby area to cap the nozzles by the cap members, moves in the opposite direction to wipe the nozzle surface using the wiper, moves again in the first direction for ink purging, and then returns to the operational area.

20 Claims, 8 Drawing Sheets

INK JET RECORDING DEVICE HAVING A RECOVERY FUNCTION FOR RESTORING A PRINTING FUNCTION OF AN INK HEAD DURING A STANDBY MODE THEREOF

BACKGROUND OF THE INVENTION (a) Field of the Invention

The present invention relates to an ink jet recording device such as an ink jet printer, and more particularly, to an ink jet recording device having a recovery function for recovering or restoring a printing function of an ink head.

(b) Description of the Related Art

A non-impact recording technique has the advantage in that very little noise is generated in a recording operation, and has become popular in recent years. Among other non-impact recording devices, an ink jet recording device is especially superior in that it is capable of directly printing onto a recording sheet at a high speed and with a simple mechanism Various proposals have been made thereto.

In a conventional ink jet printer using the ink jet recording technique, foreign materials such as paper powder may adhere onto the nozzle surface of the ink head. If the ink adhered onto the nozzle surface dries or increases in stickiness, an ink ejection nozzle of the nozzle surface becomes clogged to cause defective ejections. For preventing such defective ejections, some ink jet printers have a recovery function wherein the ink staying in the nozzles is absorbed by a pump towad the ink chamber during a standby mode of the printer after the nozzles are closed by cap members, and the nozzle surface is then wiped for cleaning by a wiper.

A conventional ink jet printer having a recovery function is described in JP-A-8-187869. The ink jet printer described therein prevents ink scattering and color mixing while preventing the ink nozzles on the nozzle surface from clogging by using the recovery function. Ink scattering signifies a problem in which the printing quality is deteriorated because the ink attached to the wiper after cleaning the nozzle surface is scattered onto a recording sheet dug the contact of the wiper with the ink head. Color mixing signifies a problem in which the printing quality is deteriorated by the movement of dark colored ink into an ejection nozzle for light colored ink and subsequent ejection of the resultant turbid color ink at the start of the print operation, which is generally caused by the wiping of the nozzle surface wherein the ink nozzles for different colored ink are disposed adjacent to one other.

The conventional ink jet printer as described above alleviates the problematic ink scattering and color mixing by using a recovery system wherein the wiper touches the nozzle surface only when it is necessary for the recovery function. The recovery system requires a transfer mechanism for transferring the rotation of the drive motor for moving the wiper to the nozzle surface, which increases, however, the number of constituent elements in the ink jet printer and involves an cost increased thereof.

SUMMARY OF THE INVENTION

It is therefore an object of the present invention to provide an ink jet recording device having an improved recovery system for suppressing the generation of ink scattering and color mixing, which also reduces the fabrication cost by simplifying the moving mechanism for the wiper.

It is another object of the present invention to provide an ink jet recording device which simplifies the moving mechanism for a cap member for closing an in nozzle of the ink head.

The present invention provides an ink jet recording device comprising a base, an ink head assembly slidably supported by the base for moving between an operational area for ink ejection and a standby area for recovery operation, the ink head assembly having an ink head for ejecting ink through an ink ejection nozzle, a wiper assembly including a wiper element for wiping the ink ejection nozzle and a wiper support for supporting the wiper element, the wiper support being moved by movement of the ink head assembly to carry the wiper element between a contact position wherein the wiper element is in contact with the ink ejection nozzle and a non-contact position wherein the wiper element is not in contact with the ink ejection nozzle.

In accordance with the ink jet recording device of the present invention, the recovery operation can be effected by the movement of the ink head assembly itself, which reduces the constituent elements of the ink jet recording device and reduces the power consumption for the recovery operation.

The above and other objects, features and advantages of the present invention will be more apparent from the following description, with reference to the accompanying drawings.

PREFERRED EMBODIMENTS OF THE INVENTION

Figure 1:
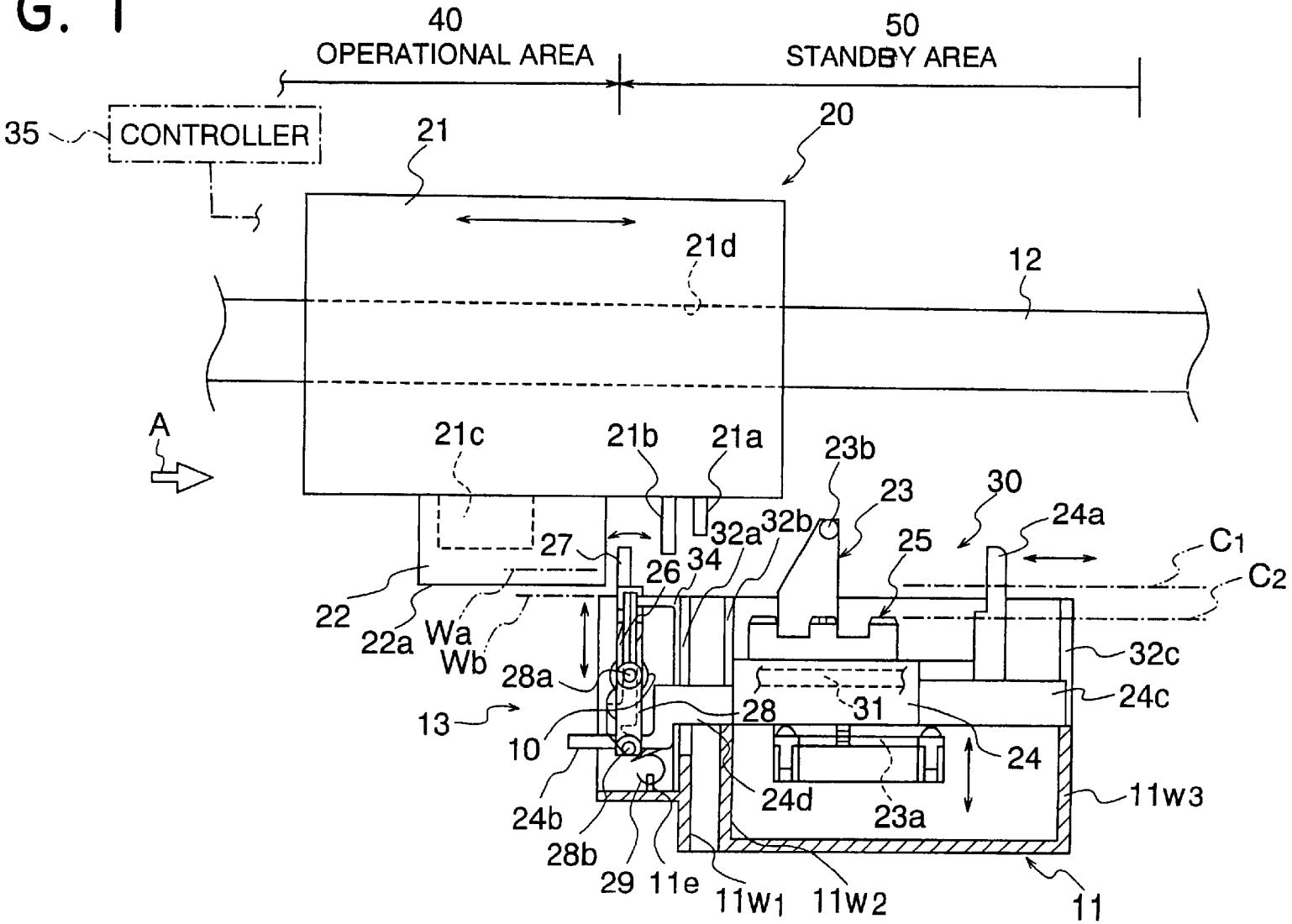
FIG. 1 is a front view of an ink head and associated recovery mechanisms in an ink jet recoding device according to an embodiment off the present invention, wherein the ink jet recording device is embodied as an ink jet printer.

Now, the present invention is more specifically described with reference to accompanying drawings. Referring to FIG. 1, an ink jet recording device according to an embodiment of the present invention is constructed as an ink jet printer.

The ink jet printer has a controller 35 on which a fixed program is to be run for performing the controls in the ink jet printer. A guide shaft 12 is supported on a base frame (not shown) of the ink jet printer, extending normal to the feeding direction of recording sheets. An ink head assembly 20 has an ink head 22 and a head carriage 21 mounting thereon the ink head 22 and having a guide hole 21*d* though which the guide shaft 12 penetrates, whereby the head carriage 21 is slidably mounted on the guide shaft 12. The head carriage 21 is moved by a stepping motor (not shown) along the guide shaft 12 between an operational area 40 for printing and a standby area 50 for recovery operations.

The ink head 22 protrudes from the bottom surface of the head carriage 21 by receiving a driving force from a piezoelectric element. The bottom of the ink head 22 constitutes a nozzle surface 22*a* on which a number of ink ejection nozzles (ink jet slits) are disposed for ejecting colored ink toward a recording sheet. Three ink ejection nozzles for ejecting respective colored inks are arranged in the moving direction of the head carriage 21 to form a nozzle combination, and a large number of nozzle combinations are arranged in the moving direction. The bottom surface of the head carriage 21 has a wiper retracting rib 21*a* and a cap sliding rib 21*b* both protruding therefrom adjacent to the side of the ink head 22 near the standby area 50. The bottom surface of the head carriage 21 also has a capping rib 21*c* at the rear side of the ink head 22.

A housing 11 for a recovery system is disposed below the guide shaft 12 in the standby area 50 for supporting a wiper assembly 13 installed adjacent the side wall of the housing 11 near the operational area 40 and a cap mechanism 30 installed substantially in the housing 11. The housing 11 has a shape of a box having guide grooves 32*a,* 32*b,* and 32*c* extending substantially in the vertical direction on respective walls $\mathbf{11}w_1$, $\mathbf{11}w_2$ and $\mathbf{11}w_3$ of the housing 11. The ribs, projections and guide grooves are adapted to transfer the movement of the head carriage 21 to the recovery system.

In the housing 11, a cap holder 24 mounting three cap members 25 is supported for vertical and horizontal movement so that the cap members 25 are adapted to the movement of the nozzle surface 22*a*. The cap members 25 have a shape adapted to entirely close the respective ink nozzles formed on tie nozzle surface 22*a* of the ink head 22.

The cap holder 24 has glides 24*d* and 24*c* projecting in the moving direction of the head carriage 21. The guide 24*d* is received in the guide grooves 32*a* and 32*b,* whereas the guide 24*c* is received in the guide groove 32*c*. On the top of the cap holder 24, each cap member 25 is secured by a buffer spring (not shown in the figure), and a projection 24*a* is formed for abutment against the cap sliding rib 21*b*.

A shaft 31 is installed in the housing 11 parallel to the moving direction of the head carriage 21. A cap lever 23, which is pivotally mounted on the shaft 31, has a thrust projection 23*b* at the top of the front side of the cap lever 23 and an arm 23*a* at the bottom of the front side of the cap lever 23. The arm 23*a* is curved such that the bottom of the arm extends toward the front side, and urged by a spring toward a normal position thereof. The cap holder 24 is supported by the arm 23*a* on the bottom side of the cap holder 24, and is urged toward the wiper assembly 13 by a slide spring not shown in the figure and also downward by a tensile spring 500 not shown in the figure.

In the configuration as described above, the cap holder 24 is moved by the arm 23*a* upward and downward depending on forward and backward pivots of the cap lever 23, and slides to the normal position thereof at which the cap holder 24 abuts against the wall $\mathbf{11}_{W2}$ during the free state or an absence of the pivot of the cap lever 23 being pivoted.

The wiper assembly 13 has a wiper bracket 28 disposed for movement in the vertical direction relative to the housing 11, a wiper element 26 fixed on the top of the wiper bracket 28, and a wiper lever 27 supported by the wiper bracket 28 for pivoting in the clockwise direction from the normal position thereof as viewed in FIG. 1. In the housing 11, an ink absorbent 34 is fixed so as to be in contact with the wiper element 26 at the top thereof.

The wiper element 26 is formed as an elastic plate made of a synthetic resin, for example, and is capable of wiping the nozzle surface 22*a* to remove the ink adhered thereto. The wiper lever 27 is pivotally supported by a shaft 28*a* relative to the wiper bracket 28. The wiper lever 27 is urged in the counterclockwise direction in FIG. 1 by a torsion spring 10 having a coil section fixed to the shaft 28*a,* which controls the pivoting of the wiper lever 27 to exceed the illustrated position. The wiper lever 27 is supported for movement at the position where it is in contact with the wiper retracting rib 21*a* disposed on the bottom surface of the head carriage 21.

At the tip of the guide 24*d,* an extension 24*b* having a shape substantially of a crank shaft is formed extending horizontally below the wiper bracket 28 toward the operational area 40. The top of the extension 24*b* abuts against the bottom of the wiper bracket 28 to lift the same during a rising movement of the cap holder 24.

Figure 2:
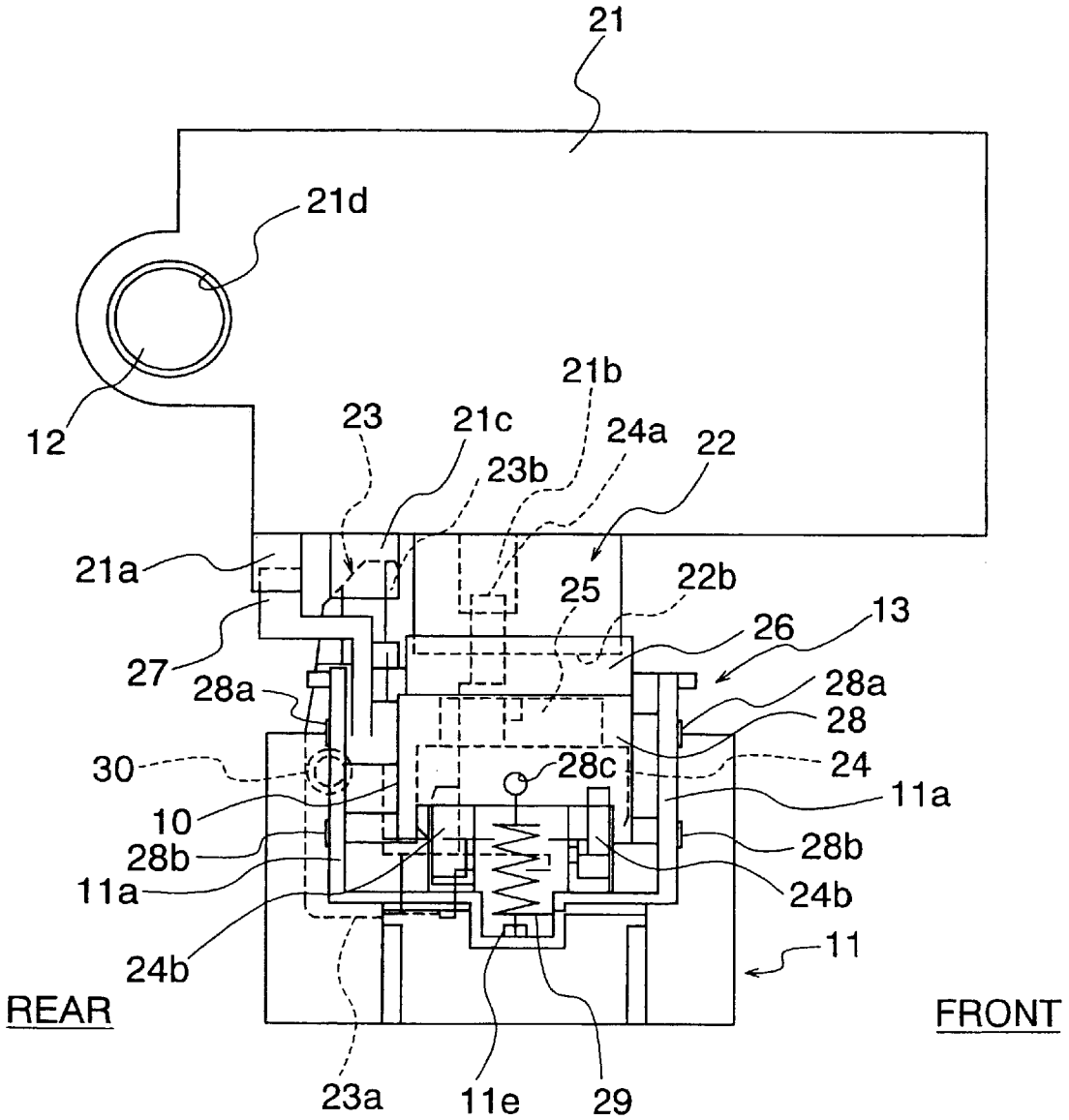
FIG. 2 is a side view of the wiper assembly shown in FIG. 1 as viewed in the direction of arrow "A"
Figure 3:
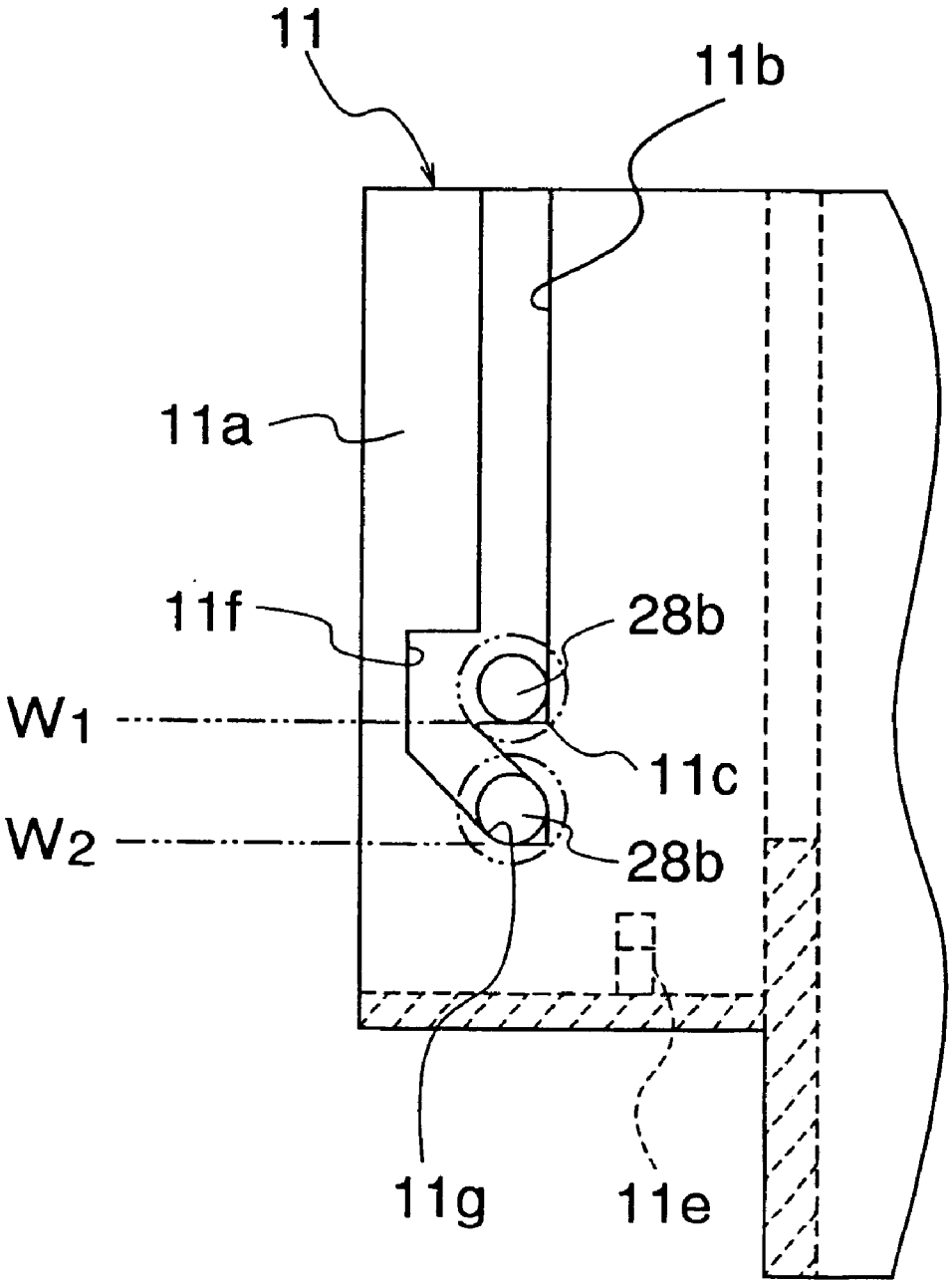
FIG. 3 is an enlarged partial front view of the cap mechanism shown in FIG. 1.

Referring to FIG. 2 showing the wiper assembly 13 as viewed in the direction of arrow "A" in FIG. 1, front and rear walls 11*a* of the wiper assembly 13 has respective guide grooves 11*b,* such as shown in FIG. 3, extending substantially vertically except for tie bottom portion thereof. Guide pins 28*a* and 28*b* of the wiper bracket 28 are slidably received in the guide grooves 11*b*. The wiper element 26 fixed at the top of the wiper bracket 28 has a sufficient width for wiping the nozzle surface 22*a* of the ink head 22. The wiper lever 27 has a base supported coaxially with the guide pin 28*a* disposed on the rear side of the wiper bracket 28. The top of the wiper lever 27 is urged by the torsion spring 10 toward the operational area (front side of the drawing). The wiper lever 27 has a shape similar to a crank shaft and abuts at the top thereof against the wiper retracting rib 21*a* fixed on the bottom of the rear side of the head carriage 21. A tensile coil spring 29 is disposed for extension between a locking projection 11*e* formed inside the housing 11 and a locking hole 28*c* formed in the center near the bottom of the wiper bracket 28.

Near the rear side of the wiper bracket 28, the shaft 31 extending parallel to the guide shaft 12 supports the central portion of the cap lever 23 for rotation. The thrust projection 23*b* of the cap lever 23 protrudes in the forward direction, whereas the arm 23*a* bends forward from a suitable position. The extension 24*b* extending from the capping mechanism 30 toward the operation area 40 has a shape similar to a fork and supports the wiper bracket 28 at the bottom surface thereof.

The capping rib 21*c* is fixed onto the bottom surface of the head carriage 21 near the rear side of the ink head 22 but in front of the wiper retracting rib 21*a*. The cap sliding rib 21*b* is fixed onto the bottom surface of the head carriage 21 near the capping mechanism 30 and in the front of the capping rib 21*c*. The wiper retracting rib 21*a* abuts the free end of the wiper lever 27 to pivot the same in the clockwise direction as viewed in FIG. 1 against the torsion spring 10, when the head carriage 21 moves from the operational area toward the standby area, or in the first direction.

The capping rib 21*c* has a cam surface for thursting the projection 23*b* to the left in FIG. 2, when the head carriage 21 moves in the first direction from the operational area toward the standby area, to pivot the cap lever 23 on the shaft 31 in the counterclockwise direction as viewed in FIG. 2. Upon the pivoting, the cap lever 23 moves the cap holder 24 and the cap members 25 to a capping position or operational position $C_1$ shown in FIG. 1 wherein the cap members 25 attach to the nozzle surface 22*a*. On the other hand, when the ink head 22 moves in the second direction from the standby area toward the operational area, the cap lever 23 pivots on the shaft 31 in the clockwise direction in the figure after being released from the capping rib 21*c* to move the cap members 25 to the standby position or non-capping position $C_2$ shown in FIG. 1 by removing the cap members from the nozzle surface 22*a*.

When the head Age 21 moves from the operational area to the standby area in the first direction, the cap sliding rib 21*b* abuts against the projection 24*a* a little before the position at which the ink head 22 reaches the end of the standby area, whereby the cap sliding rib 21*b* trusts he projection 24*a* by a further movement of the carriage 21 in the same direction to slide the cap holder 24 to the end of the standby area. At this stage, since the cap lever 23 pivots and the cap members 25 rise, as described above, the cap members 25 adhere to the nozzle surface 22*a* at the end position of the carriage 21.

FIG. 3 is an enlarged partial view of the rear wall of the housing 11 of the wiper assembly 13. Near the bottom portion of the guide groove 11*b*, a locking corner 11*c* is formed for receiving the guide pin 28*b* when it is raised together with the wiper bracket 28, in the operational position $W_1$ against the tensile coil spring 29. In addition, a pin rest 11*g* is foamed at the bottom of the guide groove 11*b* just under the locking corner 11*c* for receiving the guide pin 28*b* when it is positioned, together with the wiper bracket 28, at the standby position $W_2$. An offset section 11*f* is disposed between the pin rest 11*g* and the locking corner 11*c*, for guiding the guide pin 28*b* into and out of the locking corner 11*c*.

By the configuration described above, the wiper element 26 moves between a contact position or operational position Wa of FIG. 1 wherein the wiper element 26 protrudes by a fixed amount toward the nozzle surface 22*a* and a non-contact position or standby position Wb wherein the wiper element 26 retracts by a fixed amount from the nozzle surface 22*a*.

The locking projection 11*e* is offset from the vertical central line of the guide groove 11*b* toward the capping mechanism 30 so that the spring force acting on the wiper bracket 28 is directed toward the lower right in FIG. 3. As a result, the guide pin 28*b* can be secured in the locking corner 11*c* for locking the wiper assembly 13 in the operational position.

The wiper bracket 28, the tensile coil spring 29, the locking corner of the guide groove 11*c* and the wiper lever 27 in combination constitute means for shifting the wiper element 26 in the wiper assembly 13. The cap holder 24 having the extension 24*b*, the projection 24*a* and the cap lever 23 in combination constitute means for moving the cap members 25 in the capping mechanism 30.

Referring to FIGS. 4 through 8, there is shown a detailed operation of the ink head according to the present embodiment.

Figure 4:
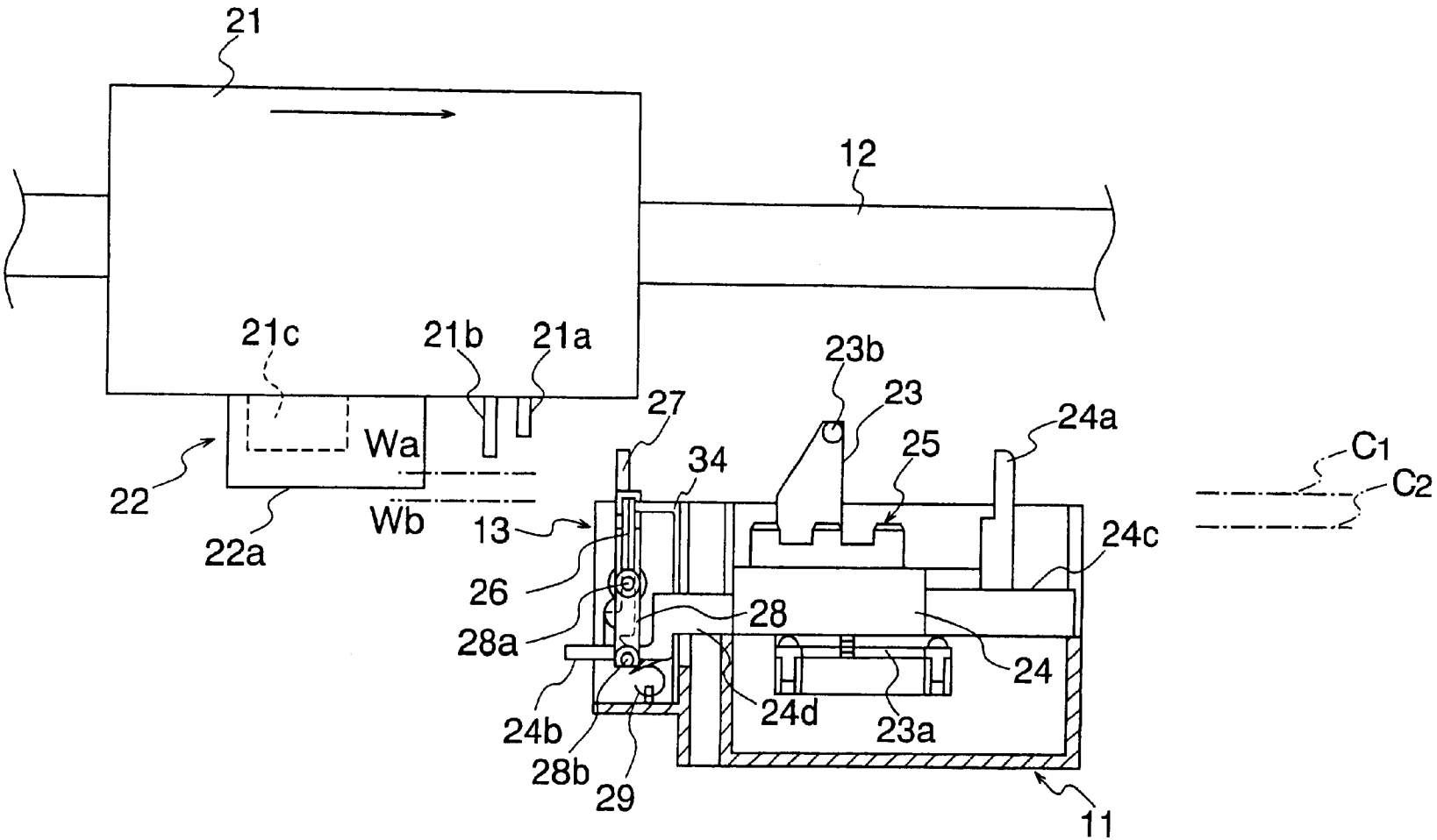
FIGS. 4 to 8 are front views of the ink jet printer of FIG. 1 for consecutively showing the operational steps thereof.

In FIG. 4, the head carriage 21 is illustrated as moving in the first direction from the operational area toward the standby area for the recovery operation of the ink head 22 under the control of the controller 35. The recovery operation is conducted when a press button (not shown in the figure) is operated by an operator. At this stage, in the wiper assembly 13, the guide pin 28*b* is released from the locking corner 11*c* of the guide groove 11*b* and is positioned at the pin rest 11*g* of the guide groove 11*b*. That is, the wiper lever 27 resides in the normal position wherein the wiper lever 27 is aligned with the wiper bracket 28, and is thereby passed over by the wiper retracting rib 21*a* moving toward the standby area. On the other hand, in the capping mechanism 30, the cap lever 23 resides at the normal pivotal position thereof, and the cap members 25 reside at the standby position $C_2$.

The wiper element 26 resides at the standby position Wb to allow the head carriage 21 to pass toward the standby area without the nozzle surface 22*a* of the ink head 22 being touched by the wiper element 26. In addition, after the wiper retracting rib 21*a* and the cap sliding rib 21*b* pass the cap lever 23, the capping rib 21*c* thrusts the projection 23*b* toward the rear side. As a result, the cap lever 23 pivots on the shaft 31 so that the arm 23*a* raises the cap holder 24 and the cap members 25 toward the capping position or operational position $C_1$. At the same time, the wiper bracket 28 is also trust upward by the extension 24*b*, with the guide pins 28*a* and 28*b* guided along the guide groove 11*b*.

Figure 5:
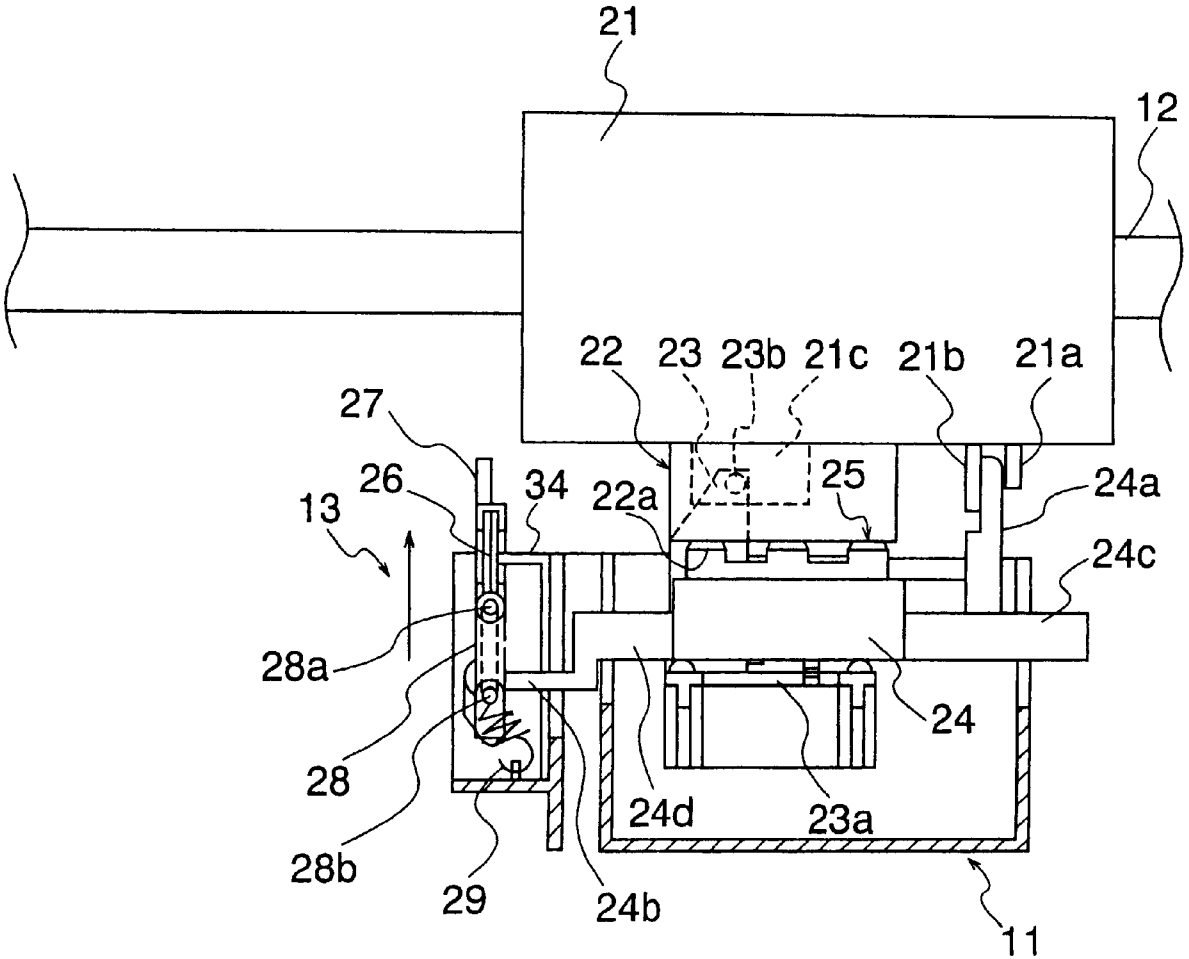

Subsequently, as shown in FIG. 5, the cap sliding rib 21*b* thrusts the projection 24*a* toward the end of the standby area so that the cap members 25 are moved toward the end of the standby area while resting in contact with the nozzle surface 22*a*. When the head carriage 21 reaches the end of the standby area, the cap members 25 are placed at the capping position $C_1$ to close the nozzle on the nozzle surface 22*a*. To reach this stage, in the wiper assembly 13, the guide pin 28*b* first exceeds the height of the locking corner 11*c* against the tensile coil spring and then is received in the locking corner 11*c* so that the fall of the guide pin is prohibited by locking the guide pin 28*b* in the locking corner 11*c* by the tension in the coil spring.

In the capping mechanism 30, the cap lever 23 is prohibited from returning to the normal pivotal position by the capping rib 21*c*, with an absence of the spring force by the tensile coil spring 29 acting against the wiper bracket 28. As a result, the cap members 25 are maintained at the capping position $C_1$, as shown in FIG. 5. In this state, an ink absorbing member (not shown in the figure) is operated to absorb ink from each ink nozzle of the nozzle surface 22*a*, while the nozzles are closed by the cap members 25, to remove the clogging of the nozzles by the remaining ink therein.

Figure 6:
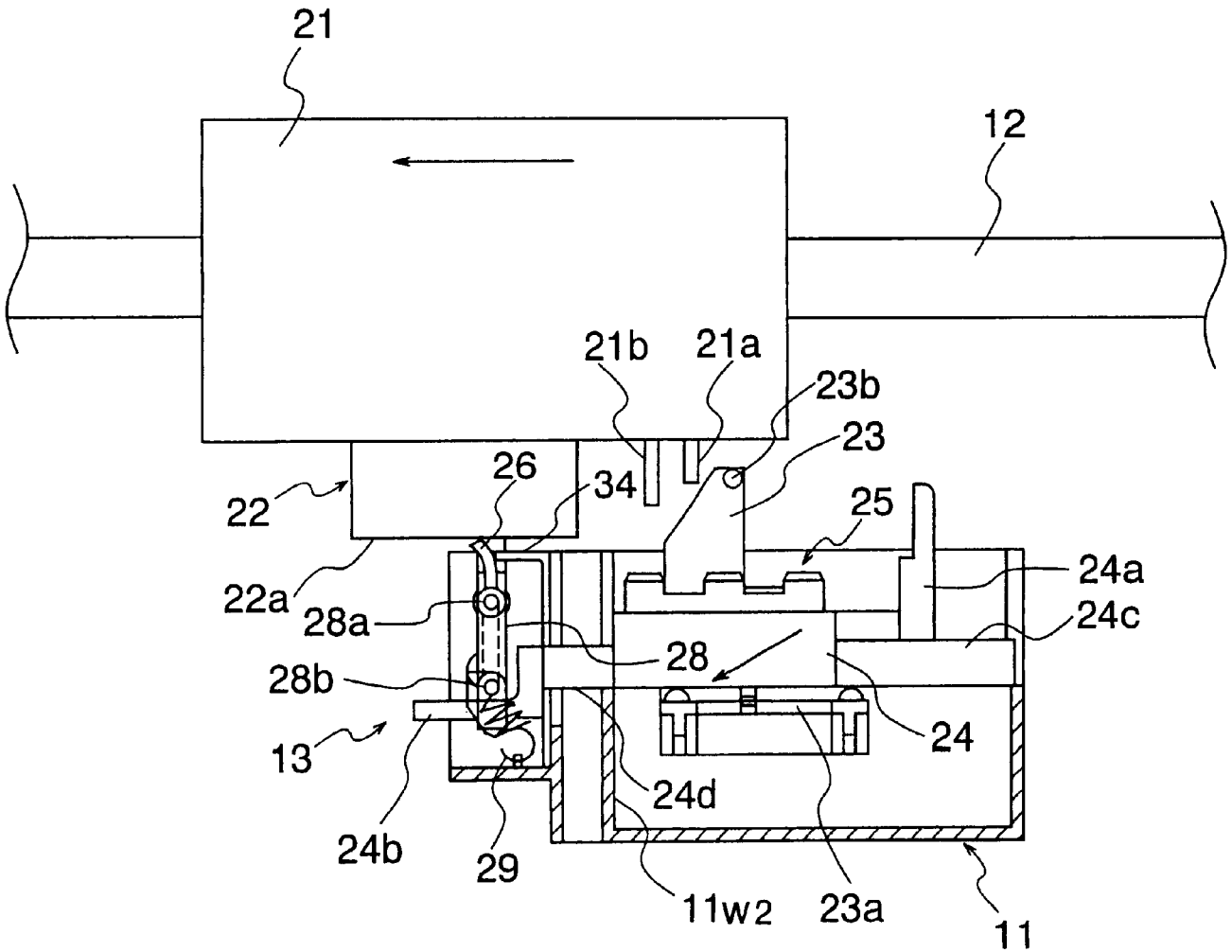

After the ink absorption, the head carriage 21 is moved in the second direction toward the operational area, as shown in FIG. 6. By the movement of the head carriage 21, the projection 24*a* is released from the capping rib 21*c*, and the trust projection 23*b* of the cap lever 23 is gradually released from the capping rib 21*c*. The cap holder 24 then falls by the function of the spring for pivoting the cap lever 23 toward the normal position thereof irrespective of the movement of the wiper bracket 28 until the pivoting of the cap lever 23 is prohibited by the wall 11*w*$_1$. As a result, the cap members 25 retract to the standby position or noncapping position $C_2$.

At this stage, in the wiper bracket 28, since the guide pin 28*b* is held in the locking corner 11*c* of the guide groove 11*b* by the function of the tensile coil spring 29, the wiper element 26 stays in the operational position or contact position Wa. Accordingly, so long as the head carriage 21 moves in the same direction, the nozzle surface 22*a* of the ink head 22 is wiped by the top edge of the wiper element 26 having elasticity, as shown in FIG. 6. The wiped ink is absorbed by the ink absorbent 34 disposed in contact with the wiper element 26.

Figure 7:
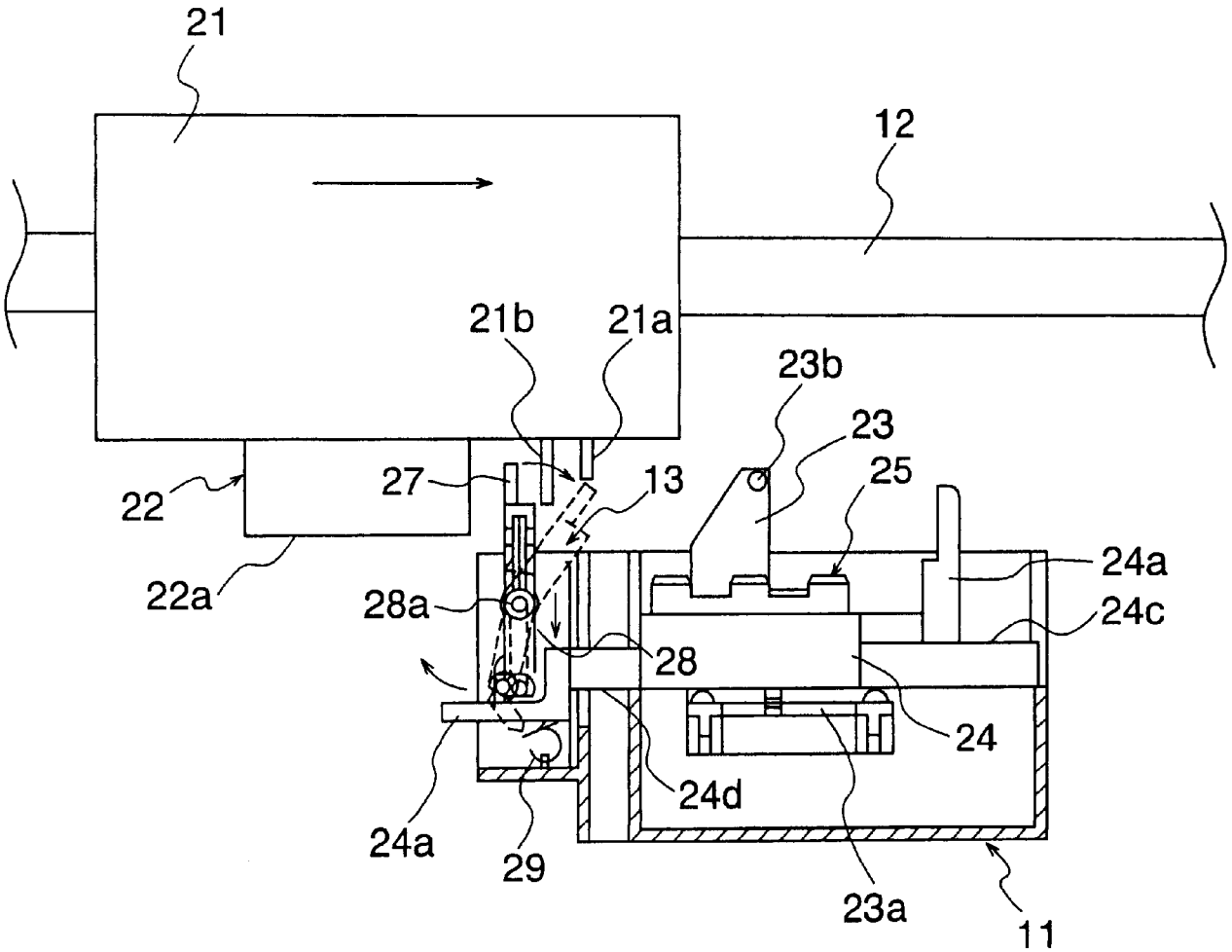

After the wiping operation for the nozzle surface 22*a*, as shown in FIG. 7, the head carriage 21 starts moving again toward the standby area for performing a purge operation (ink ejecting operation) as one of the head recovery operations. The wiper lever 27 resides at the top position where tile wiper lever 27 is in contact with the wiper retracting rib 21*a* so that the wiper lever 27 is thurst by the wiper retracting rib 21*a* to pivot in the clockwise direction, as shown by the dotted line in FIG. 7. The pivoting force of the wiper lever 27 is transferred to the wiper bracket 28 through the torsion spring 10. As a result, the wiper bracket 28 pivots in the same direction, where upon the guide pin 28*b* received in the locking corner 11*c* of the guide groove 11*b* moves toward the offset section 11*f* of the guide groove 11*b*. The guide pin 28*b* then falls together with tie guide pin 28*a* by the function of the tensile coil spring 29 toward the pin rest 11*g*.

As a result, the wiper bracket 28 falls, and the wiper element 26 retracts to the standby position or non-contact position Wb. The wiper lever 27 also falls after it is released from the wiper retracting rib 21*a* and returned to the normal pivotal position. Since the wiper element 26 retracts before the movement of the ink head 22 toward the standby area, the wiping process for the ink head 22 is not effected.

Figure 8:
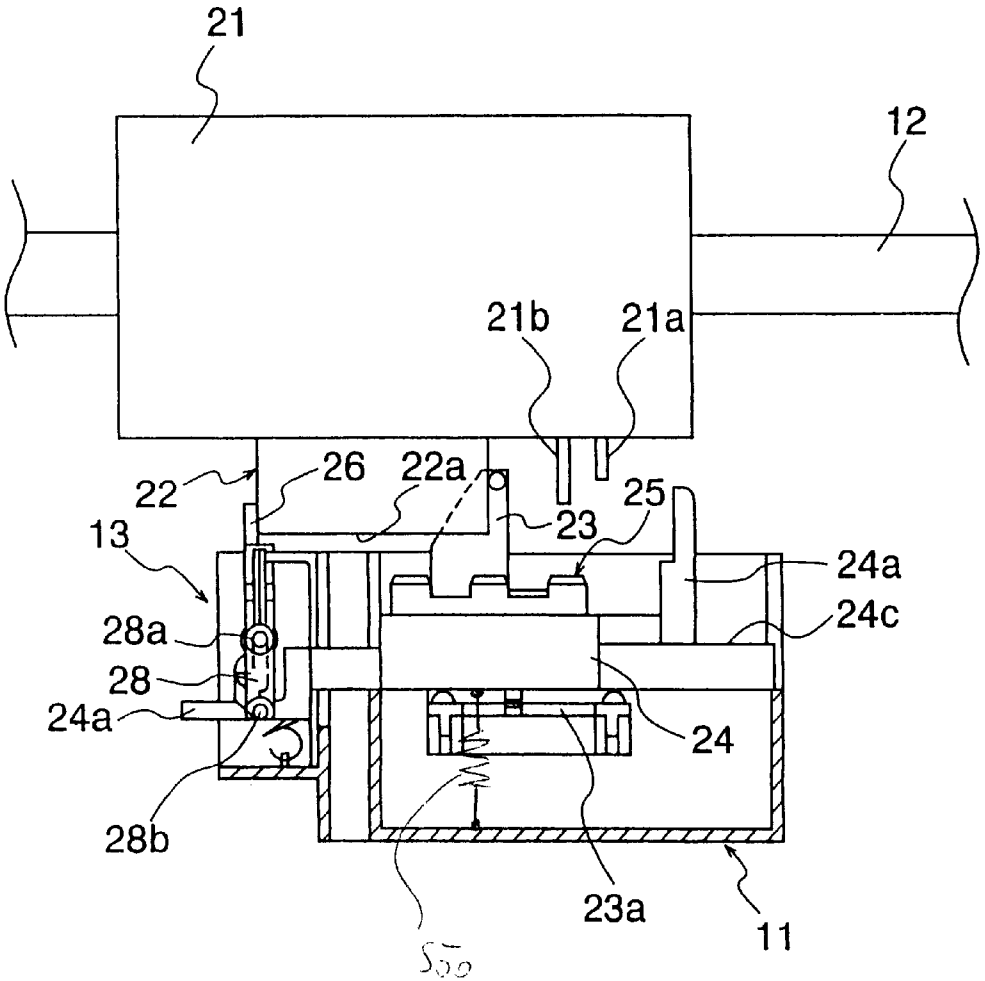

The ink head 22 again enters the standby area, as shown in FIG. 8, and stops at the point after the nozzle surface 22*a* passes wiper assembly 13 and before the cap sliding rib 21*b* is in contact with the projection 24*a*. At this position, ink ejection is conducted for a predetermined number of times, which ejection does not stain other elements or a recording sheet because the ink saucer (not shown in the figure) is disposed below the nozzle surface 22*a* at this point.

After finishing the ink ejection, the head carnage 21 moves in the second direction from the position shown in FIG. 8 toward the operational area 40. At this stage, wiper element 26 retracts to the standby position Wb and the wiper lever 27 also retracts from the operational position, whereby the nozzle surface 22*a* is not touched by the wiper element 26.

As described above, in the ink jet printer according to the present invention, movement of the head carriage 21 between the operational area and the standby area is used for moving the wiper element 26 to the contact position after the ink head 22 passes the wiper element 26. In addition, the wiper element 26 can be retracted to the standby position as a result of the ink head 22 returning to the standby area after the movement to the operational area from the standby area. By these operations, the wiper element 26 is moved to the contact position only when the ink wiping process is needed, which effects the prevention of ink scattering and color mixing during the recovery operation. Moreover, the driving mechanism of the wiper element 26 can be simplified to thereby reduce the fabrication costs of the ink jet printer. Further, the cap members 25 advance to the capping position C1 or retract to the non-capping position C2 by the movement of the ink head 22, which also simplifies the driving mechanism of the cap members 25.

The driving of the wiper assembly 13 and the capping mechanism 30 by the movement of the ink head 22 eliminates the need for a motor or power therefor. Thus, the entire mechanism for the recovery operation can be simplified, and the number of the constituent elements in the ink jet printer is reduced compared with the conventional one.

Since the above embodiment is described only an example, the present invention is not limited to the above embodiment and various modifications or alterations can be easily made therefrom by those skilled in the art without departing from the scope of the present invention.

What is claimed is:

1. An ink jet device comprising:

an ink head assembly movable between an operational area for ink ejection and a standby area for a recovery operation, said ink head assembly having an ink head for ejecting ink through an ink ejection nozzle;

a cap member for closing said nozzle and a cap support installed in a base for supporting said cap member, said cap support being movable by movement of said ink head assembly to carry said cap member between a capping position wherein said cap member closes said ink ejection nozzle and a non-capping position wherein said cap member is retracted from said ink ejection nozzle; and a wiper assembly including a wiper element for wiping said ink ejection nozzle and a wiper support for supporting said wiper element, said wiper support engageable with said cap support, such that movement of said cap support to carry said cap member to said capping position also moves said wiper support to carry said wiper element to a contact position in which said wiper element can contact said ink ejection nozzle, and wherein said wiper support can be moved upon contact with said ink head assembly to shift said wiper element to a non-contact position in which said wiper element cannot contact said ink ejection nozzle.

2. An ink jet recording device as defined in claim 1, wherein said ink head assembly moves during a first period from said operational area toward said standby area in a first direction, and moves during a second period subsequent to said first period in a second direction opposite to said first direction, and wherein said wiper element is placed in said contact position in said first period and remains in said contact position and makes contact with said ink ejection nozzle during said second period.

3. An ink jet recording device as defined in claim 2, wherein said cap member moves to said capping position and non-capping position during said first period and said second period, respectively.

4. An ink jet recording device as defined in claim 3, wherein said ink head assembly moves during a third period subsequent to said second period in said first direction, and moves during a fourth period subsequent to said third period in said second direction, and wherein an ink ejection operation is performed on said ink ejection nozzle a specified number of times for cleaning between said third period and said fourth period.

5. An ink jet recording device as defined in claim 4, wherein said wiper support has a wiper bracket pivotally mounted to said base, said wiper element being mounted on said wiper bracket, a first member for urging said wiper bracket toward said non-contact position for said wiper element, a locking element for locking said wiper bracket at said contact position, and a wiper lever movable upon contact by said ink head assembly during said third period for pivoting said wiper bracket to shift said wiper element from said contact position to said non-contact position.

6. An ink jet recording device as defined in claim 5, wherein said cap support has:

cap holder movably mounted to said base for vertical and horizontal movement, said cap member being mounted on said cap holder, a second member for urging said cap holder toward said non-capping position of said cap member, and a cap lever movable by the movement of said ink head assembly during said first period for simultaneously moving said cap holder from said non-capping position to said capping position of said cap member and said wiper bracket from said non-contact position to said contact position of said wiper element.

7. An ink jet recording device as defined in claim 6, wherein said wiper support is vertically movable to an up or down position.

8. An ink jet recording device as defined in claim 7, wherein said wiper support moves vertically up to said contact position when said cap holder is vertically moved up.

9. An ink jet recording device as defined in claim 8, wherein said wiper support is moved vertically down to a position where said wiper element cannot contact said ink jet nozzle to allow said ink head assembly to move to said standby area.

10. A method for suppressing generation of ink scattering and color mixing in an ink jet recording device of the type which includes an ink head having at least one ink nozzle, said ink head being moveable between an ink ejection area wherein it ejects ink and a storage area, a cap for closing said ink nozzle, said cap being moveable between a storage position and a nozzle closing position, and a wiper for cleaning said ink nozzle, said wiper being moveable between a storage position and a wiping position, said method comprising:

moving said ink head from said ink ejection area to its storage position while said cap member and said wiper are not in said nozzle closing position and said wiping position, respectively;

translating said cap member into said nozzle closing position while said ink head is in its storage position so as to close said ink nozzle;

moving said wiper into its wiping position, wherein said wiper is moved with said cap member to said wiping position when said cap member is moved to said nozzle closing position;

moving said cap member away from said nozzle closing position to open said ink nozzle; and while said wiper is in said wiping position, causing said wiper to wipe said nozzle.

11. A method for suppressing generation of ink scattering and color mixing in an ink jet recording device according to claim 10, further comprising absorbing of ink from said at least one ink nozzle before moving said cap member away from said nozzle closing position.

12. A method for suppressing generation of ink scattering and color mixing in an ink jet recording device according to claim 10, further comprising locking of said wiper in said wiping position.

13. A method for suppressing generation of ink scattering and color mixing in an ink jet recording device according to claim 10, further comprising ejecting ink from said at least one ink nozzle for a predetermined number of times after causing said wiper to wipe said nozzle.

14. An ink jet printing device comprising:

an ink head having a plurality of ink nozzles for ejecting ink onto a recording medium to effect printing on the recording medium during a printing operation; and a cap member and a wiper element each disposed on a respective support and each being moveable to make contact with at least one of said ink nozzles, wherein said cap member is tranlationally moveable to make contact with at least one of said ink nozzles after said printing operation and before said wiper element makes contact with at least one of said ink nozzles; wherein said cap support and said wiper support are engageable such that said cap member and said wiper member are moveable together toward a capping position and a wiping position respectively, where each may make contact with said at least one ink nozzle.

15. The ink jet device of claim 14, wherein said ink head is selectively moveable to a standby area and an operational area away from said standby area.

16. The ink jet device of claim 15, wherein said cap member is disposed in said standby area.

17. The ink jet device of claim 16, wherein said wiper element is disposed in said standby area.

18. The ink jet device of claim 17, further comprising a lever for moving said cap member toward said at least one ink nozzle.

19. An ink jet printing device comprising:

an ink head selectively moveable to a standby area and an operational area away from said standby area, said ink head having a plurality of ink nozzles for ejecting ink onto a recording medium to effect printing on the recording medium during a printing operation;

a cap member disposed in said standby area and moveable to a capping position;

a lever for moving said cap member toward said capping position;

a wiper element disposed in said standby area and moveable to a wiping position;

an arm engaged with said cap member and said wiper element to render said members moveable together toward said capping position and said wiping position, wherein said cap member is moveable to make contact with at least one of said ink nozzles after said printing operation and before said wiper element makes contact with at least one of said ink nozzles.

20. The ink jet device of claim 19, wherein said ink head is engageable with said lever and is moveable toward said standby area to urge said cap member to make contact with said at least one nozzle by engaging said lever.

* * * * *